US005343673A

United States Patent [19]

Beanland

[11] Patent Number: 5,343,673

[45] Date of Patent: Sep. 6, 1994

[54] METHOD AND APPARATUS FOR PLACING AN INSERT IN A CONTAINER

[75] Inventors: Brian Beanland; Hampton, Peter F. Kershaw; Waves, Edward R. Costello, Coventry, all of Great Britain

[73] Assignee: Guinness Brewing Worldwide Limited, London, United Kingdom

[21] Appl. No.: 852,127

[22] PCT Filed: Oct. 16, 1990 Under 37 CFR 1.47

[86] PCT No.: PCT/GB90/01599

§ 371 Date: Mar. 10, 1993

§ 102(e) Date: Mar. 10, 1993

[87] PCT Pub. No.: WO91/06481

PCT Pub. Date: May 16, 1991

[30] Foreign Application Priority Data

Oct. 30, 1989 [GB] United Kingdom ..... 8924368.7

[51] Int. Cl.[5] ..... B65B 31/00; B65B 61/20

[52] U.S. Cl. ..... 53/470; 53/474; 53/239

[58] Field of Search ..... 53/474, 470, 471, 239, 53/238, 403, 79; 220/720, 721

[56] References Cited

U.S. PATENT DOCUMENTS

| | | | |
|---|---|---|---|
| 2,764,454 | 9/1956 | Edelstein | 53/474 X |
| 3,224,158 | 12/1965 | Baumann | 53/474 X |
| 3,981,119 | 9/1976 | Schultz | 53/470 |
| 4,383,399 | 5/1983 | Stoody | 53/470 |
| 4,510,734 | 4/1985 | Banks et al. | 53/470 X |

*Primary Examiner*—James F. Coan

[57] ABSTRACT

A method of placing an insert in a container having a neck wherein the insert is of greater longitudinal extent than the cross-section of the neck, comprising the steps of holding the insert in a first orientation while causing relative movement between the insert and the container to introduce the insert into the container through the neck and subsequently permitting the insert to move under the influence of gravity into a second, different, orientation relative to the first orientation within the container.

22 Claims, 3 Drawing Sheets

METHOD AND APPARATUS FOR PLACING AN INSERT IN A CONTAINER

This invention relates to a method of and an apparatus for placing an insert in a container having a neck where the insert is of greater longitudinal extent than the cross-section of the neck of the container. The invention relates particularly, but not exclusively, to a method of, and an apparatus for, packaging food, beverages or other commodities which are required to be stored within the container having an insert provided therein. The insert may be provided for any desired purpose, for example, to aid nucleation of bubbles when a container containing liquid under a gaseous pressure above atmospheric pressure is opened.

According to one aspect of the invention we provide a method of placing an insert in a container having a neck wherein the insert is of greater longitudinal extent than the cross-section of the neck, comprising the steps of holding the insert in a first orientation whilst causing relative movement between the insert and the container to introduce the insert into the container through the neck and subsequently permitting the insert to move under the influence of gravity into a second, different, orientation relative to the first orientation within the container.

The step of holding the insert in said first orientation whilst causing relative movement between the insert and the container to introduce the insert into the container through the neck may comprise a step of causing the insert to fall under gravity through a guideway which extends through the neck.

The method may include the step of introducing a holding member, which is provided with said guideway, through said neck into the container prior to causing said fall of the insert under gravity through the guideway.

The holding member may be positioned so that a bottom end of the guideway is at or adjacent a base part of the container.

The insert may be permitted to move under the influence of gravity into said second position by virtue of displacing the bottom end of the guideway away from the base part of the container whereby the insert can leave the bottom end of the guideway and be free to fall under the influence of gravity into said second position.

The method may include the step of subjecting the insert to a positioning force whereby after being subjected to said force the insert is disposed in a desired orientation in the container.

Said last mentioned step may be performed by engaging the insert with a lower surface of the holding member.

In said desired orientation the insert may engage the wall of the container to retain the insert in said desired orientation.

The neck may be circular in cross-section and the insert may be elongate having a greater longitudinal extent than transverse extent and in the first orientation the insert may be tilted about a transversely extending axis so as to present a projected longitudinal extent in the direction of introduction which is less than the cross-section of the neck.

The method may include the step of introducing a commodity to be stored into the container after insertion of the insert. Thereafter, the container may be sealed. The sealing may be performed so that the contents of the container are under a pressure above atmospheric pressure.

The method may include the step of moving the insert from a preorientation to said first orientation prior to insertion into the container.

Said last mentioned step may release the insert into said guideway for said fall therethrough under gravity.

The insert may have a centre of gravity disposed in relation to an abutment part of the insert which engages the base part of the container such that the insert rotates in a predetermined direction into said second position.

According to another aspect of the invention we provide an apparatus for placing an insert in the container having a neck wherein the insert has a longitudinal extent which is greater than the cross-section of the neck, the apparatus comprising a holding means to hold the insert in a first orientation whilst the insert is introduced into the container through the neck and means to permit the insert to move under the influence of gravity into a second, different orientation, relative to the first orientation after the insert has passed through the neck and into the interior of the container.

The holding means may hold the insert in a first orientation by virtue of providing a guideway which extends through the neck whereby the insert is maintained in said first orientation whilst the insert falls through said guide means under the influence of gravity.

The holding means may include a longitudinally extending body part having said guideway extending longitudinally thereof and means being provided to introduce a part of said body portion into a container, in use, so as to position a bottom end of the guide means at or adjacent a base of the container and to remove said body part from the container after positioning of said insert.

The holding means may be released from the insert by virtue of moving the holding means in a direction to withdraw the holding means from the container whereby the insert is released from the lower end of the guideway and permitted to fall under gravity into said second orientation.

The insert may have a centre of gravity disposed in relation to an abutment part of the insert which engages the base part of the container such that the insert rotates in a predetermined direction into said second position.

The holding means may include a receiving means which is adapted to receive the insert in a preliminary orientation and to move the insert into said first orientation.

Said movement of the insert into said first orientation may move the insert into alignment with said guideway and thereby permit the insert to fall from the receiving means into the guideway under the influence of gravity.

Means may be provided to move the holding means downwardly so that a bottom portion thereof engages the insert subsequent to the insert having been released from the holding means into said second orientation so as to apply a positioning force to the insert to position the insert in a desired orientation.

The apparatus may comprise a first conveyor means to convey said container to an insertion station and a second conveyor means to convey said insert into engagement with said holding means at said insertion station.

An embodiment of the invention will now be described by way of example with reference to the accompanying drawings wherein.

Figure 1:
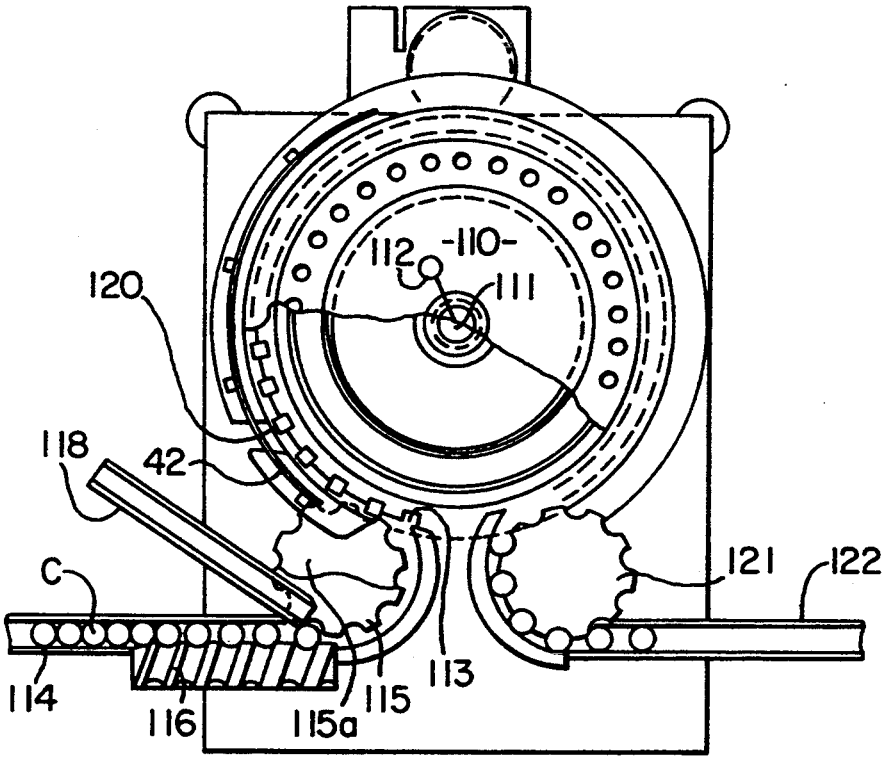
FIG. 1 is a diagrammatic plan view of an apparatus embodying the invention.

Referring to the figures, an insert placing apparatus comprises a work-table 110 rotatable about a central axis 111 by a suitable drive means 112. The table 110 has a plurality, in the present example 30, of work-stations, each having a container seat 113, each of which is adapted to receive and support a container such as a beer or soft drinks can C of essentially cylindrical configuration fed from a source of supply by a conveyor 114 onto a star feed wheel 115 via a scroll worm 116 to space the can appropriately for engagement by the star feed wheel 115. In the present example the table 110 is rotated clockwise and the star feed wheel anti-clockwise so that the cans are moving in the same direction as the seats 113 as they are moved into engagement therewith.

Inserts 1, shown in FIGS. 8 and 9, to be introduced into each can, are fed by a conveyor 118 to a second star feed wheel 115*a* positioned above the wheel 115 and which rotates therewith. The star wheel 115*a* feeds an insert to a respective insertion head 120 shown in FIGS. 2–5, associated with a container seat at each work-station.

A further star wheel 121 is provided to unload filled cans from the work-table 110 onto a conveyor 122.

In the present example, each insert 10 is made as a hollow body in synthetic plastics material and is provided with a small opening 2 in the side wall thereof. In the present example the beverage can is to be filled with a liquid beverage and after filling the can is subjected to a pressure above atmospheric pressure, the arrangement being such that gas or liquid beverage and gas under pressure within the insert is caused to be evolved through the aperture 2 when the can is opened to subject the interior of the can to atmospheric pressure and the rapid passage of beverage and/or gas through the aperture causes nucleation of bubbles or dissolved gas in the beverage. If desired the opening may be positioned in an upwardly or downwardly facing wall of the insert.

Figure 3:
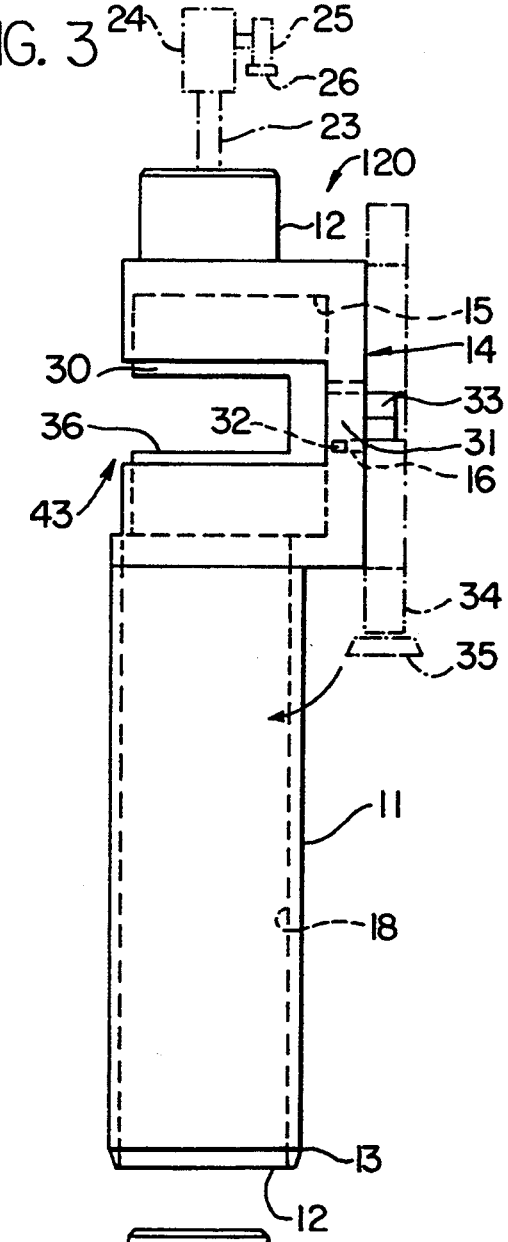
FIG. 3 is a side elevation of the holding means of FIG. 2.
Figure 4:
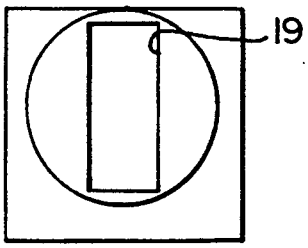
FIG. 4 is an underneath plan view of the holding means FIG. 2.
Figure 5:
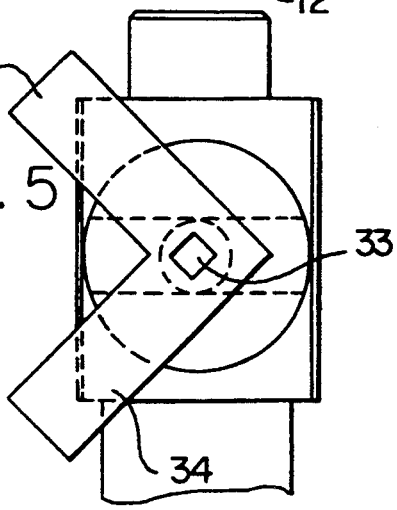
FIG. 5 is a fragmentary rear elevation of the holding means of FIG. 2.
Figure 6:
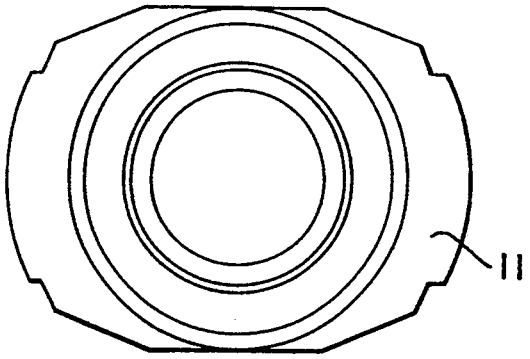
FIG. 6 is a plan view of an insert for use with the apparatus of FIGS. 1–5.

Each head 120 comprises a holding means which comprises a body 10 having a cylindrical external surface 11 and a generally circular end surface at a bottom free end 13 of the body 10. At its upper end the body 10 has a generally rectangular enlargement 14 with a part circular recess 15 formed therein with a counter-bore 16. Cheek plates 17 are fixed to the enlargement 14 on opposite sides thereof to provide an abutment at the open ends of the recess 15. In FIG. 3 the head 120 is shown with the cheek plates 17 omitted for clarity. A rectangular in cross-section slot 18 extends longitudinally through the body part 10 to provide a guideway having a rectangular exit opening 19 in the bottom surface 12 and a corresponding rectangular entry, opening 20 in a wall 21 of the recess 15. A mounting boss 22 is provided at the top of the rectangular enlargement 14 and is fastened by a link 23, shown in FIG. 3, to a carrier 24. The carrier is guided for vertical sliding movement on the table 110 under the control of a cam follower 25 rotatably mounted on the carrier 24 and which is engageable with a cam track 26 fixed relative to the table. The cam track 26 is configured to cause the carrier 24 to move up and down as the table rotates, as hereinafter described in more detail.

Mounted within the recess 15 is a receiving member 30 which has a boss 31 received in a bearing 32, the outer race of which is fixed in the counter-bore 16 so that the receiving member 30 is free to pivot about a horizontal axis. The boss 31 has a square cross-section extension 33 which is fixed to a two-armed lever 34 adapted to engage a further cam track 35 to cause the receiving member 30 to be pivoted about the horizontal axis, as hereinafter to be described.

Figure 2:
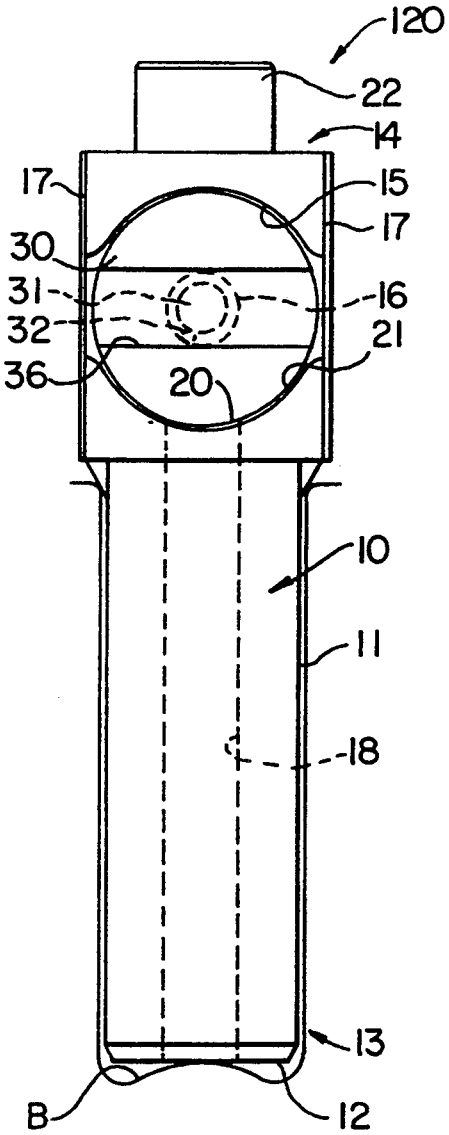
FIG. 2 is a front elevation of a holding means of the apparatus of FIG. 1.

The receiving member 30 is of generally cylindrical configuration but with a rectangular in cross-section slot 36 formed therein. The slot 36 is dimensioned to receive an insert 1 from the star wheel 115*a* when the slot 36 is orientated with its axis horizontal as shown in FIGS. 2 and 3, either in the orientation shown in FIG. 7 or with the insert in the reverse, i.e. upsidedown, orientation. A guide rail 42 is provided to prevent the insert falling from the open mouth 43 of the insert as the work-table 110 rotates.

Figure 7:
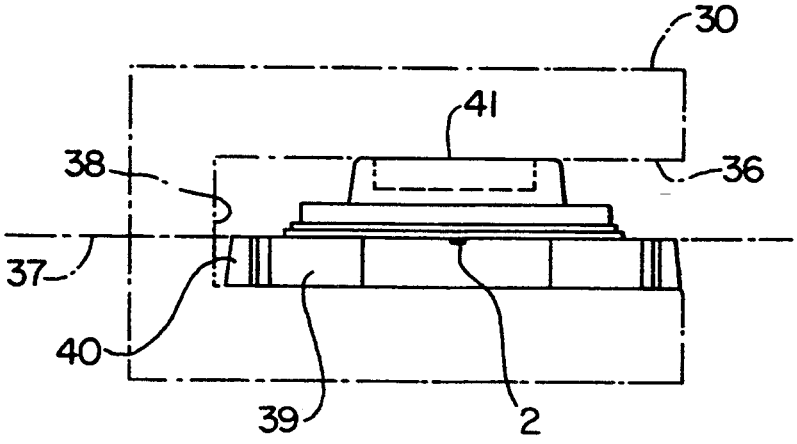
FIG. 7 is a side elevation of the insert of FIG. 6.

The insert is of such a configuration that its centre of gravity is displaced above, in FIG. 7, the line 37 which passes through the circumferential edge 38 of a larger diameter part 39 of the insert.

In use, an insert 1 is fed to the slot 36 of the receiving means 30 by star wheel 115*a* and as the table 110 continues to rotate the cam track 26 causes the head 120 to be moved downwardly so that the body part 10 is received within a container C, see FIG. 2, which has been fed to the work-table by the star wheel 115. When the body is fully lowered into the container C, so that its bottom end is touching the base B of the container, continued rotation of the work-table causes the cam 35 to engage the lever 34 to cause the receiving member 30 to pivot through 90° to align the slot 36 with the slot 18 so that the insert 1 can fall, under the influence of gravity, from the slot 36 through the slot 18 until the larger diameter part 39 of the insert engages the base B of the container C with its peripheral surface 40.

Continued rotation of the work-table then causes the cam 26 to raise the body 11 sufficiently so that the insert is released from the bottom end of the guideway 18 as a result of the force of gravity acting upon the insert maintaining it in engagement with the base B of the container C whilst the body 11 is raised. When the top edge part of the surface 40 of the insert is freed from the exit opening 19 of the guideway 18, the insert fails under gravity, due to the above described disposition of its centre of gravity so that the smaller diameter part 41 thereof falls into engagement with the base B of the container.

In case the insert does not fall fully through 90° the cam 26 causes the body part 11 to be again moved downwardly to engage the upper surface of the insert and apply a positioning force thereto so that the insert is forced if necessary into a desired position in which its smaller diameter part 41 fully engages the base B of the container with the insert lying perpendicular to the longitudinal axis of the container. Where the container has a domed base as illustrated, this facilitates the above described rotation of the insert as it is released from the lower end of the body.

Whilst it is preferred that the bottom of the body 10 engages the base B, if desired the bottom of the body may be spaced above the base B, although it is preferred that the separation is less than the longitudinal extent of the insert so that the insert is not free from the guide means until the body 22 is raised. This prevents free fall of the insert into contact with the base without being guided by the guide means and therefore avoids any problems which could arise due to bouncing of the insert when not guided leading to incorrect rotation of the insert towards the desired orientation.

After the insert has been thus positioned within the container the work-table 110 continues to rotate until the can and insert are positioned at a filling station where beverage is introduced into the can. Thereafter the continued rotation of the work-table moves the thus filled can to a further star wheel 121 which is provided to unload filled cans from the work-table 110 onto a conveyor 122. Although the particular case of a can to be filled with beverage and a particular form of insert have been described hereinbefore, the invention can be applied to cans that are filled with other material such as a food or other commodity and the insert may be provided for any desired purpose.

The features disclosed in the foregoing description, or the following claims, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

I claim:

1. A method of placing an insert in a container having a neck wherein the insert is of greater longitudinal extent than the cross-section of the neck, comprising the steps of holding the insert in a first orientation while causing relative movement between the insert and the container to introduce the insert into the container through the neck and subsequently permitting the insert to move under the influence of gravity into a second, different, orientation relative to the first orientation within the container, said step of holding the insert in said first orientation while causing relative movement between the insert and the container to introduce the insert into the container through the neck comprises a step of causing the insert to fall under gravity through a guideway which extends through the neck.

2. A method according to claim 1 wherein the insert has a centre of gravity disposed in relation to an abutment part of the insert which engages the base part of the container such that the insert rotates in a predetermined direction into said second position.

3. A method according to claim 1 including a step of introducing a holding member, which is provided with said guideway, through said neck into the container prior to causing said fall of the insert under gravity through the guideway.

4. A method according to claim 3 wherein the holding member is positioned so that a bottom end of the guideway is at or adjacent a base part of the container.

5. A method according to claim 4 wherein the insert is permitted to move under the influence of gravity into said second position by virtue of displacing the bottom end of the guideway away from the base part of the container whereby the insert can leave the bottom end of the guideway and be free to fall under the influence of gravity into said second position.

6. A method according to claim 5 including a step of subjecting the insert to a positioning force whereby after being subjected to said force the insert is disposed in a desired orientation in the container.

7. A method according to claim 6 wherein said last mentioned step is performed by engaging the insert with a lower surface of the holding member.

8. A method according to claim 1 wherein in said desired orientation the insert engages the wall of the container to retain the insert in said desired orientation.

9. A method according to claim 1 wherein the neck is circular in cross-section and the insert is elongate having a greater longitudinal extent than transverse extent and in the first orientation the insert is tilted about a transversely extending axis so as to present a projected longitudinal extent in the direction of introduction which is less than the cross-section of the neck.

10. A method according to claim 1 wherein the method includes the step of introducing a commodity to be stored into the container after insertion of the insert.

11. A method according to claim 10 wherein, after introducing said commodity into the container, the container is sealed.

12. A method according to claim 11 wherein the sealing is performed to that the contents of the container are under a pressure above atmospheric pressure.

13. A method according to claim 1 wherein the method includes the step of moving the insert from a pre-orientation to said first orientation prior to insertion into the container.

14. A method according to claim 13 wherein said last mentioned step releases the insert into said guideway for said fall therethrough under gravity.

15. An apparatus for placing an insert in the container having a neck wherein the insert has a longitudinal extent which is greater than the cross-section of the neck, the apparatus comprising a holding means to hold the insert in a first orientation while the insert is introduced into the container through the neck and means to permit the insert to move under the influence of gravity into a second, different orientation, relative to the first orientation after the insert has passed through the neck and into the interior of the container, said holding means comprising a guideway which extends through the neck whereby the insert is maintained in said first orientation while it falls through said guide means under the influence of gravity.

16. An apparatus according to claim 15 wherein the holding means includes a receiving means which is adapted to received the insert in a preliminary orientation and to move the insert into said first orientation.

17. An apparatus according to claim 16 wherein said movement of the insert into said first orientation moves the insert into alignment with said guideway and thereby permits the insert to fall from the receiving means into the guide means under the influence of gravity.

18. An apparatus according to claim 15 wherein means are provided to move the holding means downwardly so that a bottom portion thereof engages the insert subsequent to the insert having been released from the holding means into said second orientation so as to apply a positioning force to the insert to position the insert in a desired orientation.

19. An apparatus according to claim 15 wherein the holding means includes a longitudinally extending body part having said guideway extending longitudinally thereof and means to introduce a part of said body portion into a container, in use, so as to position a bottom end of the guide means at or adjacent a base of the container and to remove said body part from the container after positioning of said insert.

20. An apparatus according to claim 19 wherein the holding means is released from the insert by virtue of moving the holding means in a direction to withdraw the holding means from the container whereby the insert is released from the lower end of the guideway and permitted to fall under gravity into said second orientation.

21. An apparatus according to claim 15 wherein the insert has a centre of gravity disposed in relation to an abutment part to the insert which engages the base part of the container such that the insert rotates in a predetermined direction into said second position.

22. An apparatus according to claim 15 comprising a first conveyor means to convey said container to an insertion station and a second conveyor means to convey said insert into engagement with said holding means at said insertion station.

* * * * *